United States Patent [19]

Palomar

[11] 4,270,311

[45] Jun. 2, 1981

[54] ESCAPE HATCH FOR DWELLINGS

[76] Inventor: Chester J. Palomar, 1401 W. 9th St., Sp. 81, Pomona, Calif. 91766

[21] Appl. No.: 40,300

[22] Filed: May 18, 1979

[51] Int. Cl.[3] ..... E05C 15/02; E05C 21/02

[52] U.S. Cl. ..... 49/141; 49/13; 49/465; 292/54; 292/218

[58] Field of Search ..... 49/465, 463, 13, 141, 49/61, 63, 464, 466; 292/218, 213, 54; 160/369

[56] References Cited

U.S. PATENT DOCUMENTS

| | | | |
|---|---|---|---|
| 243,625 | 6/1881 | Rominger | 292/218 X |
| 1,024,705 | 4/1912 | Sprague | 292/213 X |
| 1,290,283 | 1/1919 | Mitchell | 292/54 |
| 2,793,721 | 5/1957 | Sterud | 49/465 |
| 3,032,834 | 5/1962 | Carlson | 49/141 |
| 3,120,032 | 2/1964 | Burnette | 49/463 X |
| 3,724,130 | 4/1973 | Bogue | 49/141 |
| 4,034,697 | 7/1977 | Russell | 49/13 X |
| 4,106,236 | 8/1978 | Oliphant | 49/465 X |

*Primary Examiner*—Philip C. Kannan

*Attorney, Agent, or Firm*—Boniard I. Brown

[57] ABSTRACT

An escape hatch for dwellings, such as mobile homes, is provided with a panel fitting within an external wall opening of such dwelling and equipped with a plurality of peripheral latch assemblies engaging such wall. Each latch assembly has internal and external blades on the opposite faces of the hatch panel, and pivotable on a common pivot pin extending through the panel so that in one position they overlie the adjacent portion of the wall. The internal and external blades are jointed by a guide pin extending through an arcuate slot centered on the pivot pin. Conventional burglar alarm devices may be used in conjunction with the escape hatch.

8 Claims, 4 Drawing Figures

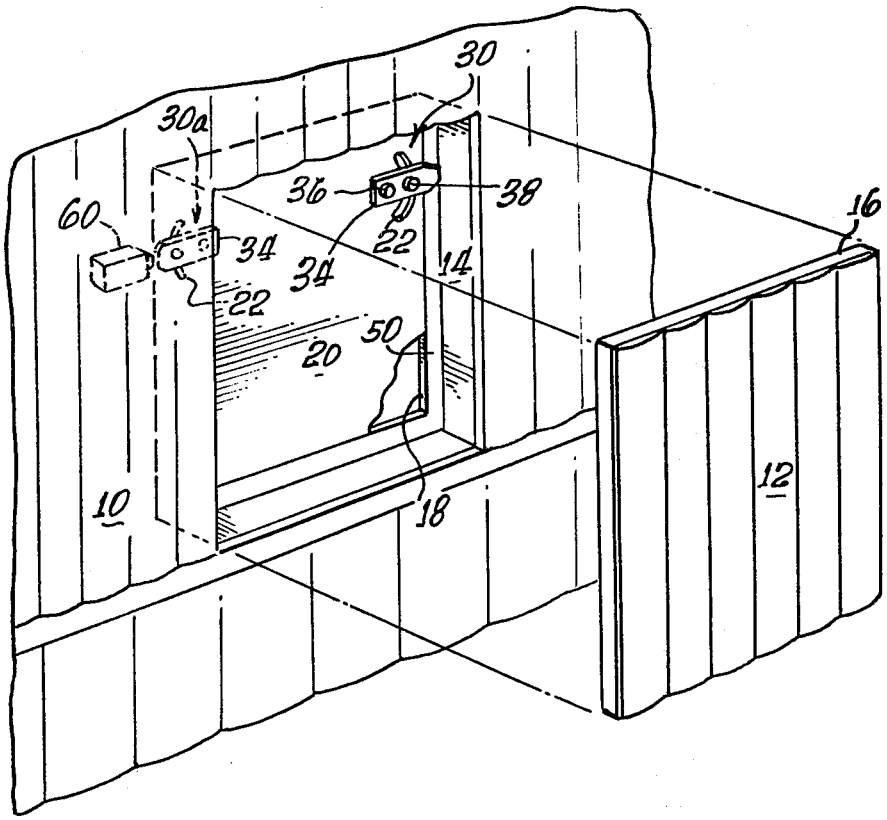
FIG. 1.
FIG. 2.
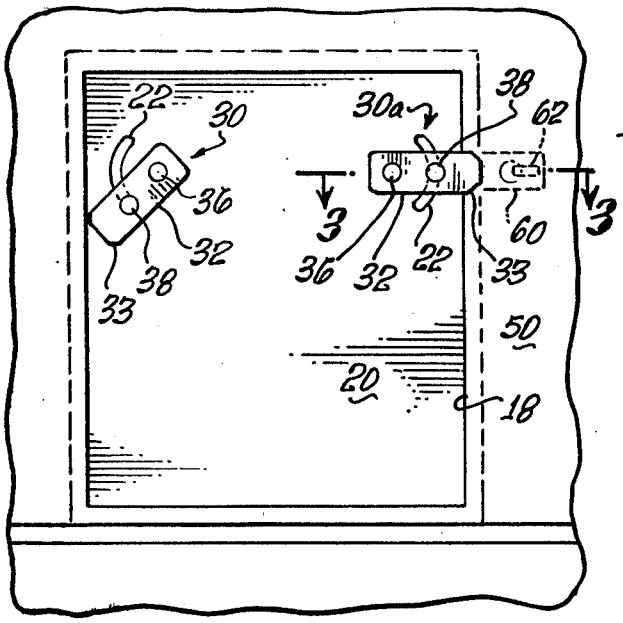
FIG. 3.
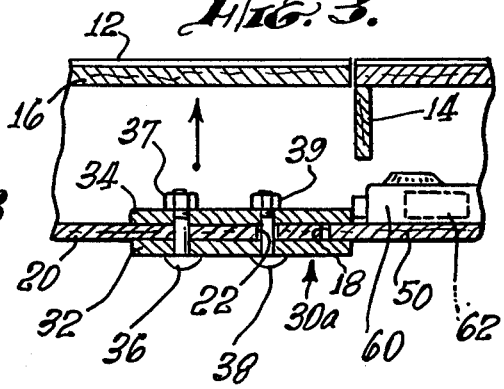
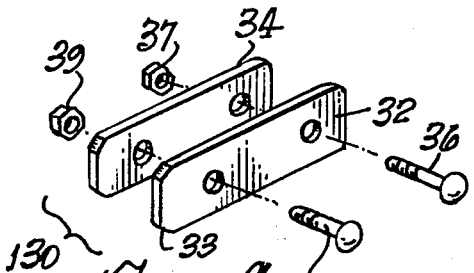
FIG. 4.

ESCAPE HATCH FOR DWELLINGS

BACKGROUND OF THE INVENTION

The invention relates to emergency exits for dwellings, and more particularly to escape hatches for mobile homes and the like with simple latch mechanisms operable from both sides of the wall panel in which the escape hatch is mounted.

In many types of dwellings—principally, but not exclusively, those of prefabricated construction, such as mobile homes—the provision of effective escape openings for emergencies, such as fires, is difficult. The installation of multiple doorways at ground level may be undesirable for many reasons. Windows may be located high in the wall panels to provide wall space for furniture or for reasons of privacy. Windows may be of such construction that their use as emergency exits is difficult, if not impossible.

This problem has been recognized and attempts have been made to improve the safety of such structures by the provision of emergency escape hatches in ground-floor wall panels facing outwardly. Such escape hatches are taught in U.S. patents to CARLSON, U.S. Pat. No. 3,032,834, to BURNETTE, U.S. Pat. No. 3,120,032 and to BOGUE, U.S. Pat. No. 3,724,130.

These constructions of the prior art have not met with substantial success for a number of reasons, including their complexity and attendant high cost, the necessity for prior instruction in the use of the locking devices whose function and location were not self-evident, and the inaccessibility of the latch mechanisms to outside rescuers, such as firemen, thus defeating, at least partially, the utility of the escape hatch.

It is therefore the primary object of the invention to provide improved emergency escape hatches for dwellings, which are of simplified construction, and which utilize simple inexpensive latches.

It is an object of the invention to provide escape hatches whose operation is self-evident to ordinary users, thus tending to insure their use in emergencies.

It is another object of the invention to provide escape hatches accessible to and operable by persons outside the dwelling structure, so as to permit the entry of rescuers in emergencies.

It is another object of the invention to teach the use of alarm devices in conjunction with the escape hatch, thus to provide immediate warning of unauthorized or improper use of the escape hatch.

SUMMARY OF THE INVENTION

The foregoing objects and other objects and advantages which shall become apparent from the detailed description of the preferred embodiment, are attained in an escape hatch consisting of an inner panel closely set into the inner wall of the dwelling, an outer panel closely set into the exterior surface of the dwelling, and a plurality of latches securing the inner panel flush with the interior wall surface.

Each latch assembly comprises a pair of blades disposed on opposite faces of the inner hatch panel, parallel to one another and to the panel, pivotable on a pivot mounted in the panel and joined or interlocked so that the blades move together. The latch may be pivotally moved between two positions: a first position wherein the blades entirely overlie the inner hatch panel, and a second position wherein the blades extend beyond the edge of the panel and overlie the adjacent wall, engaging the inner wall between them.

With the latches moved into this second position, the inner hatch panel is secured in place coplanar with the inner wall of the dwelling and covering the escape opening. With the latches rotated into the first position, the inner hatch panel is unrestrained with respect to the wall and can be moved out of position, to give access to the outer hatch panel which is secured in place by frictional contact, or, optionally, by means of latches like those provided for the inner panel.

Conventional burglar alarm devices may be provided, mounted on the inner faces of the walls in which the escape hatch is placed, and operated by the inner blade of one of the latches, so that the removal of the hatch panel will automatically trigger the alarm system. In the event of an emergency, such as a fire, the operation of the alarm in this manner is desirable, since it may summon help which otherwise would not become available. In the event of unauthorized entry through the escape hatch, the operation of the alarm will alert neighbors and law enforcement agencies.

The inner and outer panels of the escape hatch are preferrably identical to the panelling utilized in the inner and outer walls of the dwelling, thus making the escape hatch inconspicuous.

BRIEF DESCRIPTION OF THE ACCOMPANYING DRAWING

FIG. 1 is a perspective view of a portion of a dwelling wherein the escape hatch of the invention is installed, with the outer panel thereof shown removed from its opening in the dwelling wall;

FIG. 2 is a frontal view of the escape hatch of FIG. 1 and a portion of the interior wall of the dwelling;

FIG. 3 is a partial section, taken at line 3—3 in FIG. 2, of the escape hatch, showing a latch assembly securing it in place, and a burglar alarm associated therewith; and FIG. 4 is an exploded perspective view of latch assembly utilized with the invention.

DESCRIPTION OF THE PREFERRED EMBODIMENT

FIG. 1 shows a portion of exterior wall 10 of a dwelling wherein is installed an escape hatch of the invention, including an outer panel 12 shown removed from a closely fitting opening in the wall 10. The outer panel 12 is reinforced by a frame 16 and is, for reasons of aesthetics and inconspicuousness identical in material and texture to the surrounding exterior wall 10.

Inwardly of the outer panel 12 is a space, defined by the framing of the wall of the dwelling. An opening 18 in the internal wall of the structure is filled by an inner panel 20 of the escape hatch assembly. The gap between the internal and external walls of the dwelling may be framed as by boards 14, to define a chute through the wall.

The inner escape hatch panel 20 is held in position by means of a pair of latch assemblies 30, which are more fully described with reference to FIGS. 2, 3 and 4.

FIG. 2 is an elevational view of a portion of an internal wall surface 50 of the dwelling wherein the opening 18 for the escape hatch has been provided. The escape hatch opening 18 shown is substantially rectangular, it being understood that the shape and location of the hatch may be varied to accommodate the foreseen service conditions and the structure being served, without departing from the teachings herein. The opening is filled by the inner panel 20. If desirable and practicable, the panel 20 may be the actual section cut from the wall surface material 50 to create the hatch 18.

Two latch assemblies 30 for securing the inner panel 20 in position are shown in FIG. 2, with one latch assembly 30 in its "unlock" position, wherein its operating blades are clear of engagement with the wall 50 and entirely overlie the panel. The other latch assembly 30*a*, is shown in its "locked" position, with an inner blade 32 overlapping the wall, periphery adjacent to the hatch opening 18, with an outer blade 34 engaging the wall 50.

Referring to FIGS. 3 and 4, the inner and outer blades of the latch assemblies pivot on pivot bolts 36 which extend through the panel 20 and are joined for movement together by a guide pin 38 extending through an arcuate slot whose center of curvature is coincident with the pivot bolt 36. In the embodiment of FIG. 2, the included angle of the slot 22 amounts to 90 degrees, allowing for movement of a latch assembly 45 degrees in an upward direction relative to the horizontal, and the same downwardly. The outboard corners of the blades 32 and 34 are chamfered at 33 at 45 degrees, so that in the limit positions permitted by the extent of the slot 22 the blades entirely overlie the surface of the inner panel 20 and permit relative movement thereof with respect to the opening 18.

Referring to FIG. 3, outer panel 12 is inset into wall 10 and inner panel 20 is inset into wall 50. Panel 12 is unsecured, being retained by frictional forces developed by a close fit in the opening of the hatch in wall 10. It is understood that the panel 12 may be equipped with latch assemblies like the latch assemblies 30 of the inner panel 20, without departing from the concepts of the invention.

The inner hatch panel 20 is co-planar with the internal wall 50, conforming to the peripheral dimensions of the cutout hatch opening 18. Latch blades 32 and 34 flank the panel 20 and, in the "locked" position of the latch assembly illustrated, engage the wall 50 between their outboard ends. It is the primary function of the latch assemblies 30 to engage the wall adjacent to the hatch opening 18 and to maintain the panel 20 securely in place as part of the wall surface of the interior space of the dwelling structure. It is the operational function of the latch assemblies to permit ready removal of the panel 20 from its superposed location in the opening 18 should an emergency situation arise which would necessitate the evacuation of the dwelling through an escape means.

The internal blade 32 of the latch assembly is pivotable with the external blade 34 on a pivot pin or bolt 36 held in place by a nut 37, the blades being secured together by a guide pin 38, in the form of a threaded fastener retained by nut 39, extending through the slot 22.

Because of the simplicity of the latch assembly and of its movement between the "unlock" position and the normal "lock" position, even a person unskilled or uninstructed in the specific use of the latch mechanism can readily operate the hatch panel 20. This is of great importance in the provision of safety equipment, such as the improved escape hatch assembly of the invention, because the presence of equipment or structures in an emergency situation may be of no avail should training or skill be required to use or operate it, and individuals so qualified are not available.

FIGS. 2 and 3 illustrate the use of a conventional burglar alarm 60, powered by a battery 62, in conjunction with the escape hatch. The movement of the latch assembly 30*a* into the "locked" position arms the alarm by depressing a switch thereof and, interrupting an electrical circuit between the battery 62 and the siren or other signal-producing component. Movement of the latch assembly 30*a* from its normal position to its "unlocked" position removes blade 32 from contact with the switch of the alarm 60, resulting in the operation of the alarm, by the emission of a shrill sound, for example. When associated with an emergency situation, the emission of such signal, whether locally or communicated to a law enforcement or property protection agency can help. When the opening of the hatch is unauthorized, as by a burglar taking advantage of the accessibility of the escape hatch panel 20 through the panel 12, the alarm serves to alert neighbors and police.

It should be noted that the external accessibility of the escape hatch is a definite object of the invention, so as to allow would-be rescuers access to the interior of the structure. Experience has shown that often persons outside of a dwelling become alerted to fire or other unusual hazard before the residents themselves, and that also frequently sleeping persons are overcome and rendered helpless by smoke and fumes before they are able to evacuate the dwelling structure. Such problems are particularly acute in mobile homes, motorhomes and their like, and it is foreseen that the invention will fill a long-felt need in such structures.

The invention has been described with reference to its illustrated preferred embodiment. Persons skilled in the art of constructing escape hatches may, upon exposure to the teachings herein, conceive variations in the mechanical development of the components therein. Such variations are deemed to be encompassed by the disclosure, the invention being delimited only by the appended claims.

The inventor claims:

1. An improved escape hatch assembly for a dwelling having an opening in an external wall, comprising:

a hatch panel adapted to closely fit within said opening and being like said wall in thickness; and a plurality of latch assemblies, each comprising a pair of blades respectively disposed on opposite faces of said hatch panel, said blades being pivotable about a pivot pin extending through the panel and joined together by a guide pin extending through an arcuate slot centered on the pivot pin, whereby the blades are pivotable together between a first position wherein they entirely overlie the panel and a second position wherein portions thereof overlie the wall.

2. An escape hatch according to claim 1 wherein: said blades are secured together in superposed relation.

3. An escape hatch according to claim 1, wherein: said plurality of latch assemblies comprises two assemblies.

4. An escape hatch according to claim 1, wherein: at least one of said latch assemblies is operationally interconnected with a burglar alarm.

5. An escape hatch according to claim 1, wherein: said opening is substantially rectangular.

6. An escape hatch assembly according to claim 1 for the internal sheeting wall of a composite frame wall, and further including:

means defining an opening in the external siding wall of the composite wall, and a closure panel for said opening in substantial coincidence with said hatch panel.

7. An escape hatch according to claim 1, wherein:

said blades are substantially rectangular.

8. An escape hatch according to claim 7, wherein:

said blades are chamfered at their corners remote from the pivot pin.

* * * * *